US010024330B2

(12) United States Patent
Xie et al.

(10) Patent No.: US 10,024,330 B2
(45) Date of Patent: Jul. 17, 2018

(54) BLADELESS COOLING LIGHT

(71) Applicants: Jianhui Xie, Toronto (CA); Yifan Wu, Zhongshan (CA); Robert Eric Schell, Bristol, IN (US)

(72) Inventors: Jianhui Xie, Toronto (CA); Yifan Wu, Zhongshan (CA); Robert Eric Schell, Bristol, IN (US)

( * ) Notice: Subject to any disclaimer, the term of this patent is extended or adjusted under 35 U.S.C. 154(b) by 399 days.

(21) Appl. No.: 14/825,773

(22) Filed: Aug. 13, 2015

(65) Prior Publication Data

US 2016/0215782 A1 Jul. 28, 2016

Related U.S. Application Data

(60) Provisional application No. 62/106,966, filed on Jan. 23, 2015.

(51) Int. Cl.

| | |
|---|---|
| ***F04D 25/08*** | (2006.01) |
| ***F04D 29/54*** | (2006.01) |
| ***F04D 29/44*** | (2006.01) |
| ***F21V 33/00*** | (2006.01) |
| *F04D 29/62* | (2006.01) |

(52) U.S. Cl.

CPC ..... *F04D 25/08* (2013.01); *F04D 29/441* (2013.01); *F04D 29/545* (2013.01); *F21V 33/0096* (2013.01); *F04D 29/624* (2013.01)

(58) Field of Classification Search

CPC ..... F04D 25/08; F04D 29/545; F04D 29/522; F04D 25/10; F04D 29/4206; F04D 29/441; F04D 29/62; F04D 29/624; F21V 33/0096; F04F 5/16; F24F 7/007; F24H 3/041; F24H 9/0063

See application file for complete search history.

(56) References Cited

U.S. PATENT DOCUMENTS

| | | | | |
|---|---|---|---|---|
| 1,737,912 | A * | 12/1929 | Bogard | F24H 3/0417 244/134 D |
| 2012/0031509 | A1* | 2/2012 | Wallace | F04D 15/0218 137/338 |
| 2013/0243588 | A1* | 9/2013 | Lo | F04D 25/08 415/211.2 |
| 2013/0330215 | A1* | 12/2013 | Li | F04D 25/08 417/410.1 |
| 2014/0314571 | A1* | 10/2014 | Wu | F21V 33/0096 416/5 |

* cited by examiner

*Primary Examiner* — Woody Lee, Jr.
*Assistant Examiner* — Jesse Prager

(57) ABSTRACT

A bladeless cooling light includes an airflow assembly, a light assembly, and a housing. The airflow assembly includes an air circulation assembly positioned within the housing and an air passage structure connected to the housing, wherein the air circulation assembly draws air through the housing into the air passage structure. The air passage structure has a separation wall that delineates the air passage structure into an inflow air channel and an outflow air channel to improve the airflow through the air passage structure. A cone-tip hole grid and a wired heater within the air passage structure further improve airflow characteristics; the cone-tip hole grid constricts the flow, while the wired heater increases internal pressure by heating the air. The lighting assembly is mounted to the housing with the air passage structure being positioned around the lighting assembly, such that the light and expelled airflow are projected in the same direction.

19 Claims, 13 Drawing Sheets

BLADELESS COOLING LIGHT

The current application claims a priority to the U.S. Provisional Patent application Ser. No. 62/106,966 filed on Jan. 23, 2015.

FIELD OF THE INVENTION

The present invention relates generally to cooling systems. More specifically, the present invention is a bladeless cooling light with a unique airflow assembly that improves the flow characteristics of air flowing into, inside of, and out of the bladeless cooling light.

BACKGROUND OF THE INVENTION

The bladeless fan is a device that creates airflow with no external blades. The first bladeless fan was invented by Japanese company Toshiba in 1981. Since then, several bladeless fan inventions have been patented. Most notable are the patents relating to the Dyson Air Multiplier. While bladeless fans are often safer due to the lack of external blades, most bladeless fans are no more space efficient than traditional external bladed fans. Bladeless fans are often designed with an air passage that is shaped in an annular or other looped configuration, wherein air is perimetrically dispelled from the air passage. Resultantly, there is a rather large volume of unused space outlined by the air passage.

Therefore it is an object of the present invention to provide a multifunctional bladeless cooling light that enables users to more effectively cool and illuminate spaces. The present invention combines bladeless fan technology with light emitting diode (LED) lighting, resulting in an apparatus that may provide both light and cooling air to an environment. An air passage structure is positioned around a lighting assembly, wherein the cooling and lighting functions of the present invention can be used simultaneously or standalone. Furthermore, it is an objective of the present invention to provide a unique and improved bladeless fan design. The present invention improves upon existing bladeless fan technology by introducing a separation wall within the air passage structure that forms an inflow air channel and an outflow air channel to create pressure differentials within the air passage structure for improved air flow. The inflow air channel also includes a heating element to increase the pressure within the inflow channel, and the outflow air channel includes a plurality of intake orifices increasing airflow within the outflow air channel. These improvements leverage fundamental laws of fluid flow, such as Bernoulli's Law and the Venturi effect, to optimize the efficiency and effectiveness of the bladeless fan. Also, unique mounting options are provided that enable the use of the present invention in many different environments.

DETAIL DESCRIPTIONS OF THE INVENTION

Figure 1:
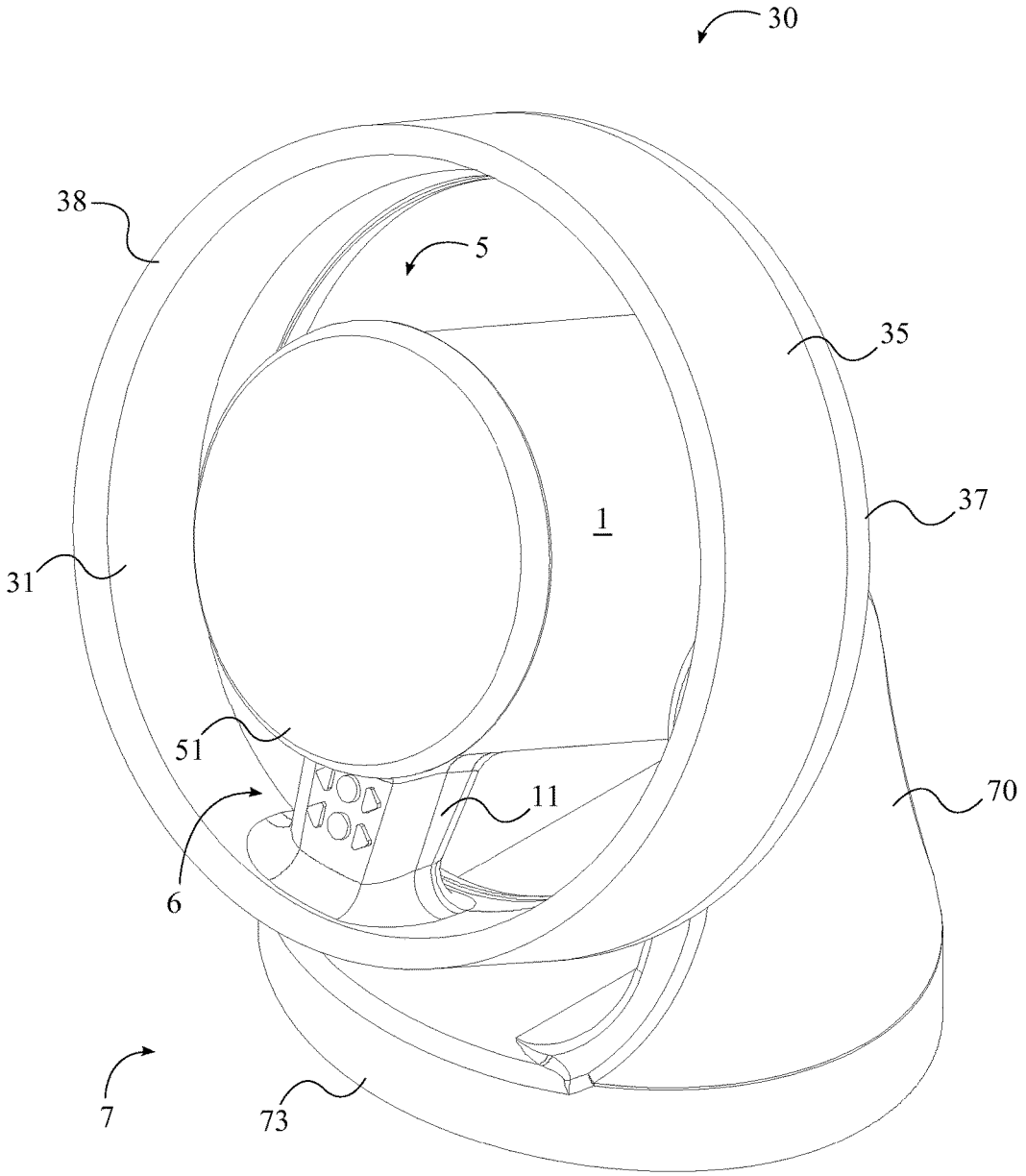
FIG. 1 is a perspective view of the present invention.

All illustrations of the drawings are for the purpose of describing selected versions of the present invention and are not intended to limit the scope of the present invention.

The present invention is a bladeless cooling light that is used to provide a cooling airflow within and illumination of a room. The bladeless cooling light comprises a housing 1, an airflow assembly 2, a light assembly 5, a control panel 6, a mounting assembly 7, and a power supply 8. The housing 1 provides the structure to support and contain the other components of the present invention. In the preferred embodiment of the present invention, the housing 1 is generally cylindrical and located centrally in correspondence to the other components of the present invention. However, it is possible for the housing 1 to be differently shaped or positioned in other embodiments of the present invention.

The airflow assembly 2 provides the means for drawing air into the present invention, internally circulating the air, and then directing the air in an exit flow. In reference to FIG. 3-4, the airflow assembly 2 comprises an air circulation assembly 20 and an air passage structure 30. The air circulation assembly 20 is positioned within the housing 1, while the air passage structure 30 is adjacently connected to the housing 1. The air circulation assembly 20 provides the means for drawing in air and directing the airflow to the air passage structure 30. The airflow is then circulated through the air passage structure 30 and directed outwards to produce the desired cooling effect.

Figure 4:
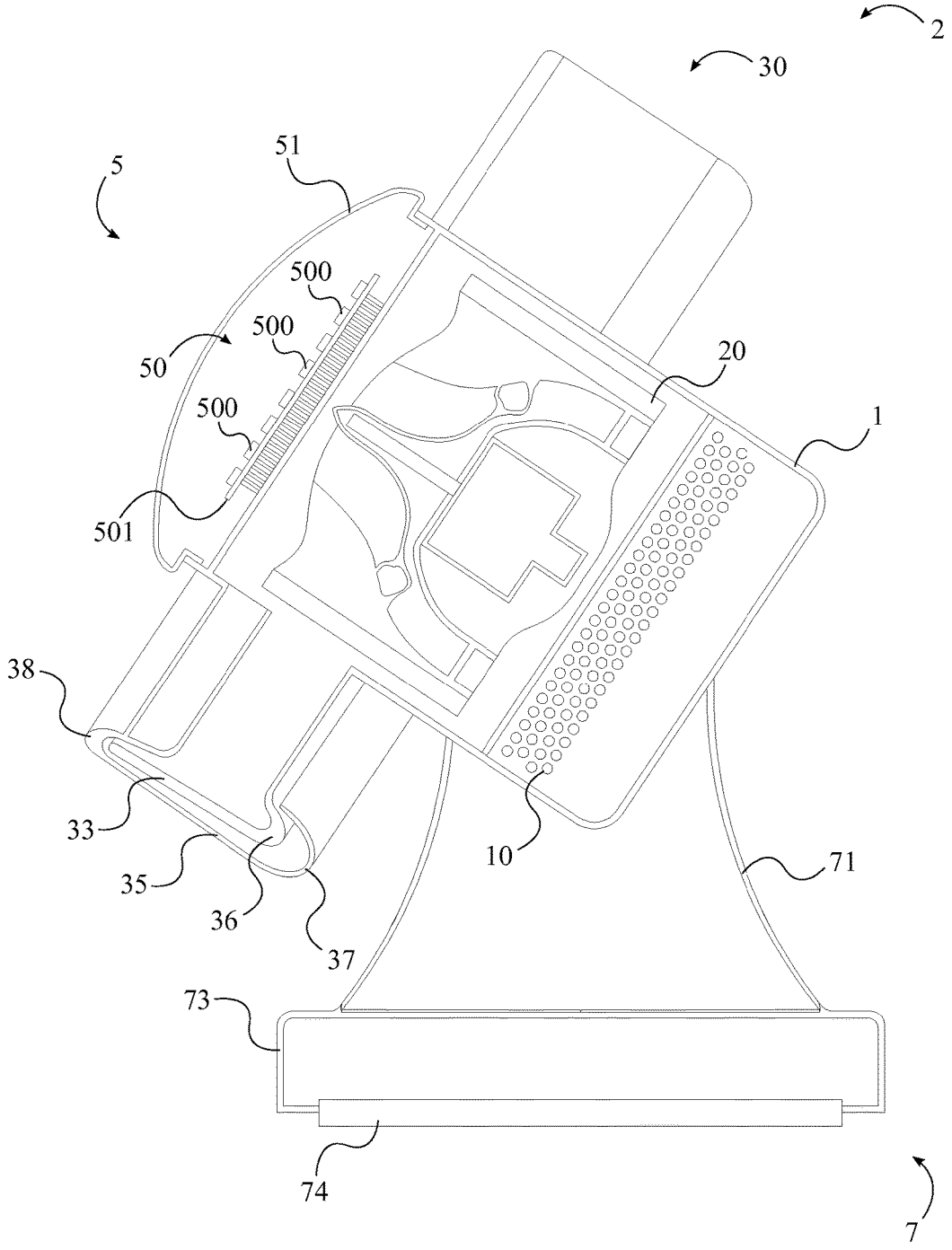
FIG. 4 is a right side sectional view of the present invention.

In reference to FIG. 1 and FIG. 4, the housing 1 comprises a main air intake 10 and an inflow air conduit 11 that direct the airflow through the airflow assembly 2. The main air intake 10 provides an opening that allows air to be pulled into the housing 1 by the air circulation assembly 20, while the inflow air conduit 11 then directs the airflow to the air passage structure 30. As such, the air circulation assembly 20 is positioned in between the main air intake 10 and the inflow air conduit 11, wherein the air circulation assembly 20 accelerates the airflow and directs the airflow towards the inflow air conduit 11. The main air intake 10 can be a single vent, multiple vents, a plurality of air holes, or any other opening that allows air to be pulled into the housing 1 from the surrounding environment.

In the preferred embodiment of the present invention, the air circulation assembly 20 is a centrifugal blower that comprises a motor and a plurality of blades. The plurality of blades is rotatably connected to the air motor, wherein the air motor spins the plurality of blades to create an airflow through the housing 1 and into the air passage structure 30. The direction of rotation of the plurality of blades, along with the orientation and curvature of the plurality of blades, pulls air into the housing 1 through the main air intake 10, accelerates the airflow, and directs the airflow through the inflow air conduit 11 to the air passage structure 30. In other embodiments of the present invention, the air circulation assembly 20 may comprise a diaphragm, piston actuator, rotary vane, rotary piston, or other means to create a directed airflow within the housing 1.

Figure 2:
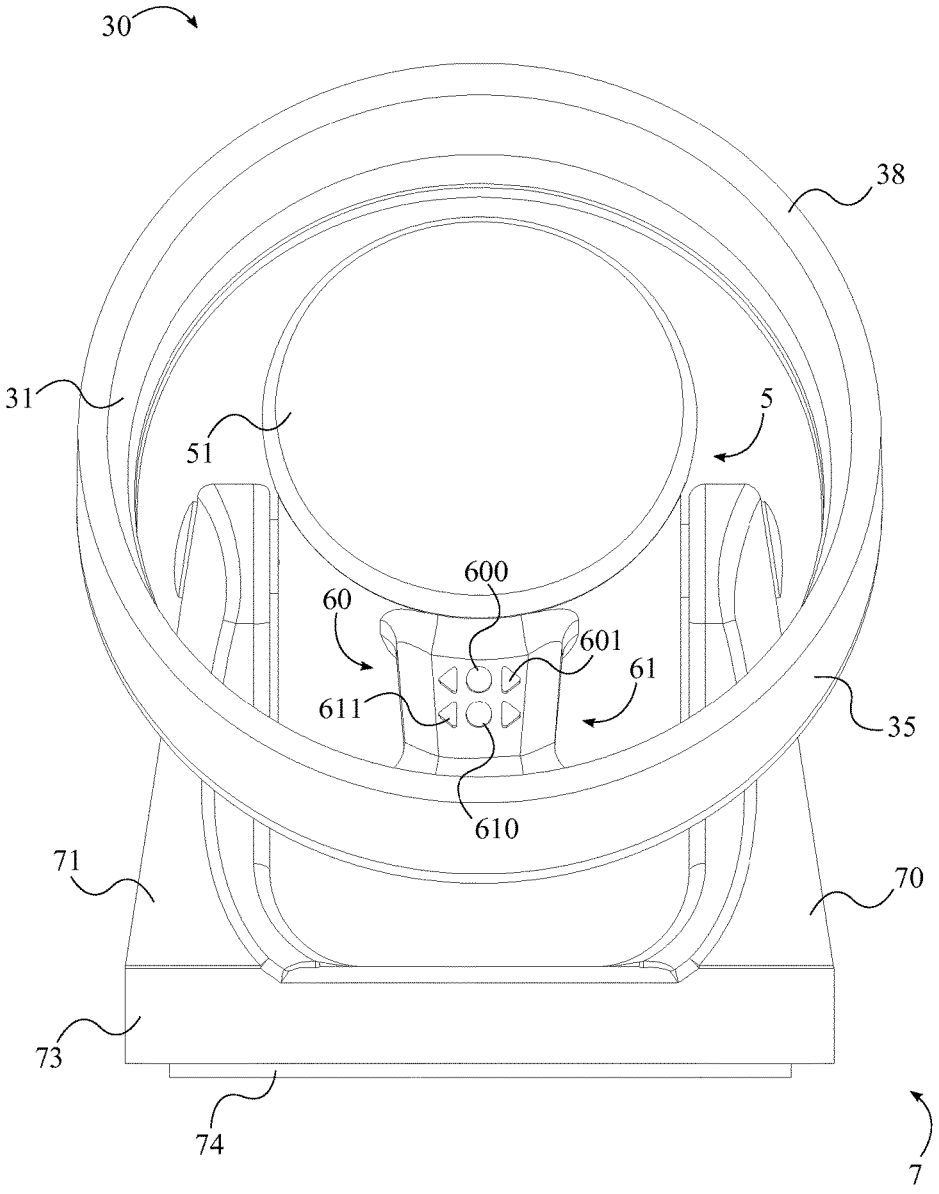
FIG. 2 is a front elevational view of the present invention.
Figure 9:
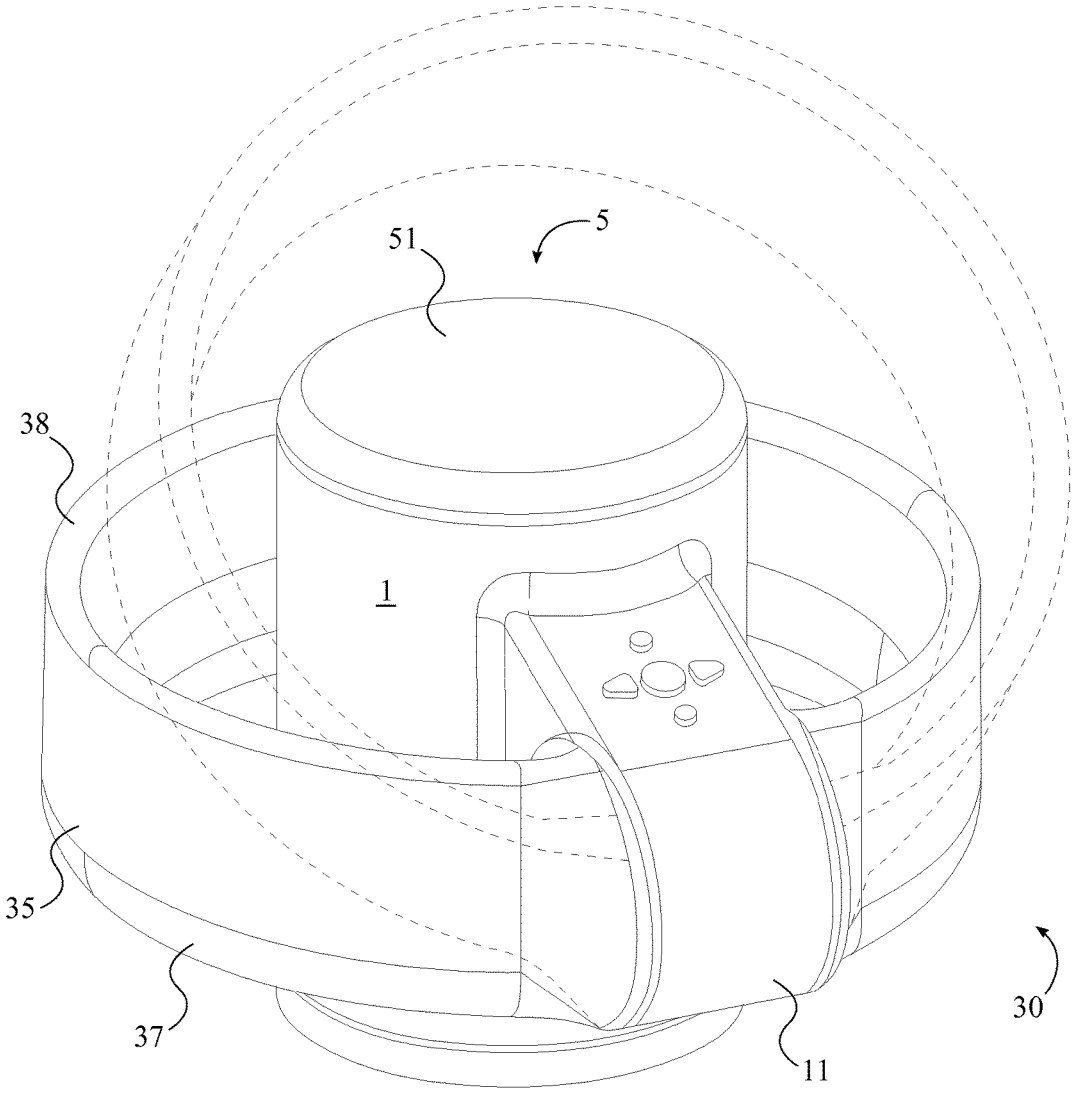
FIG. 9 is perspective view of the present invention, wherein the air passage structure is pivotally connected to the housing.

Air is directed through the inflow air conduit 11 to the air passage structure 30 by the air circulation assembly 20. As such, the air passage structure 30 is adjacently connected to the inflow air conduit 11, as shown in FIG. 1-2. The air then flows through the air passage structure 30 and is directed outwards into the room, providing a cooling air stream. In the preferred embodiment of the present invention, the air passage structure 30 is pivotally connected housing 1 as shown in FIG. 9, wherein a user can reposition the air passage structure 30 in order to change the direction of the cooling air stream.

Figure 5:
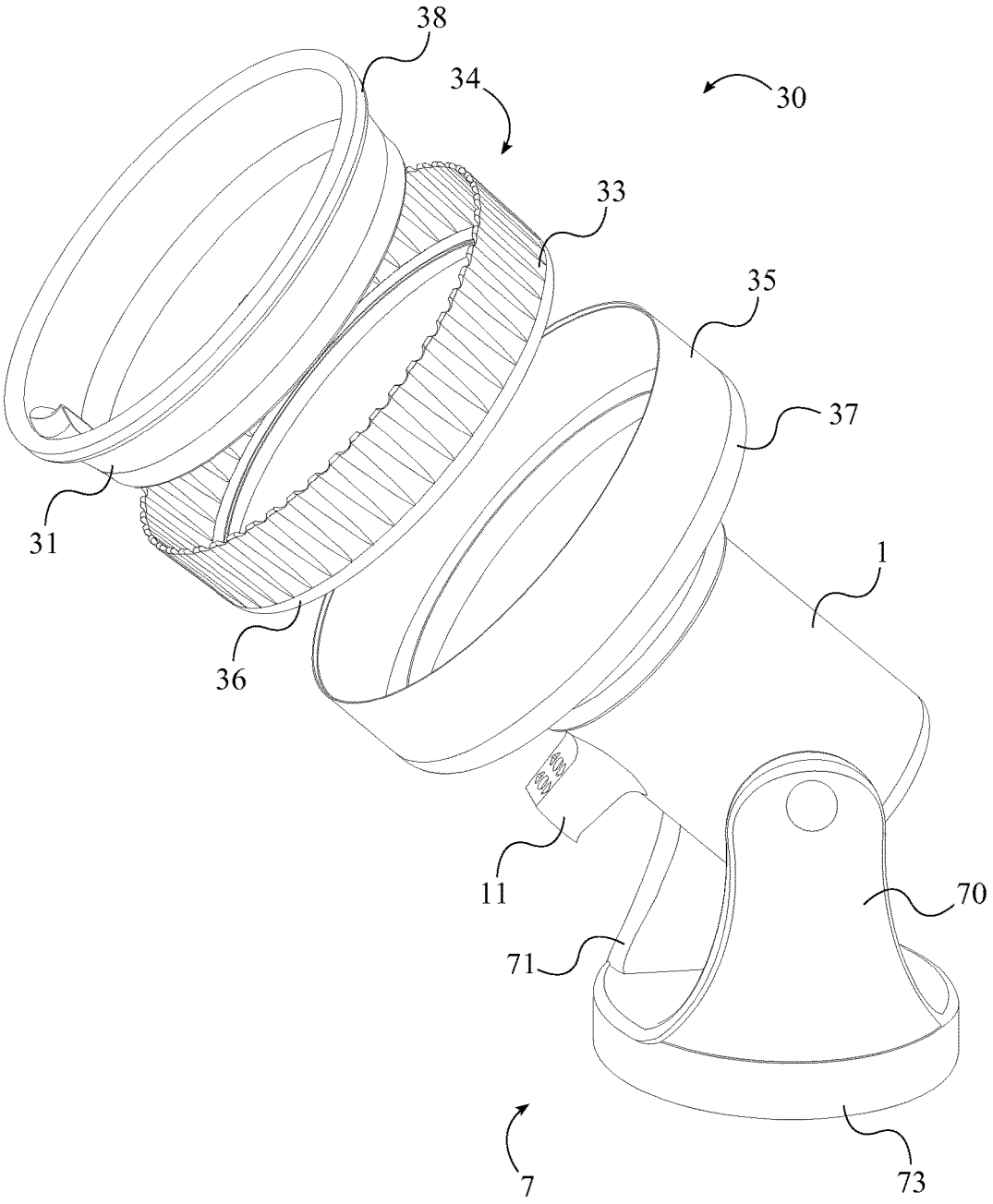
FIG. 5 is an exploded view of the present invention.

In reference to FIG. 4-5, the air passage structure 30 is configured to create multiple pressure differentials in order to generate an enhanced and more efficient cooling exit flow. In order to generate the cooling exit flow, the air passage structure 30 comprises an interior wall 31, a wired heater 32, a separation wall 33, a cone-tip hole grid 34, an exterior wall 35, a first diffuser 36, a second diffuser 37, a constrictor 38, and a plurality of intake orifices 39. The air passage structure 30 is a thin-walled, hollow component that sequentially directs air through the use of pressure differentials. Furthermore, the air passage structure 30 forms an open loop assembly, wherein air is perimetrically dispersed from the air passage structure 30. In the preferred embodiment of the present invention, the air passage structure 30 forms an annular passage way, however, the air passage structure 30 may be formed in different shapes in other embodiments of the present invention, such as rectangular, triangular, elliptical, straight, or pendant-shaped.

Figure 6:
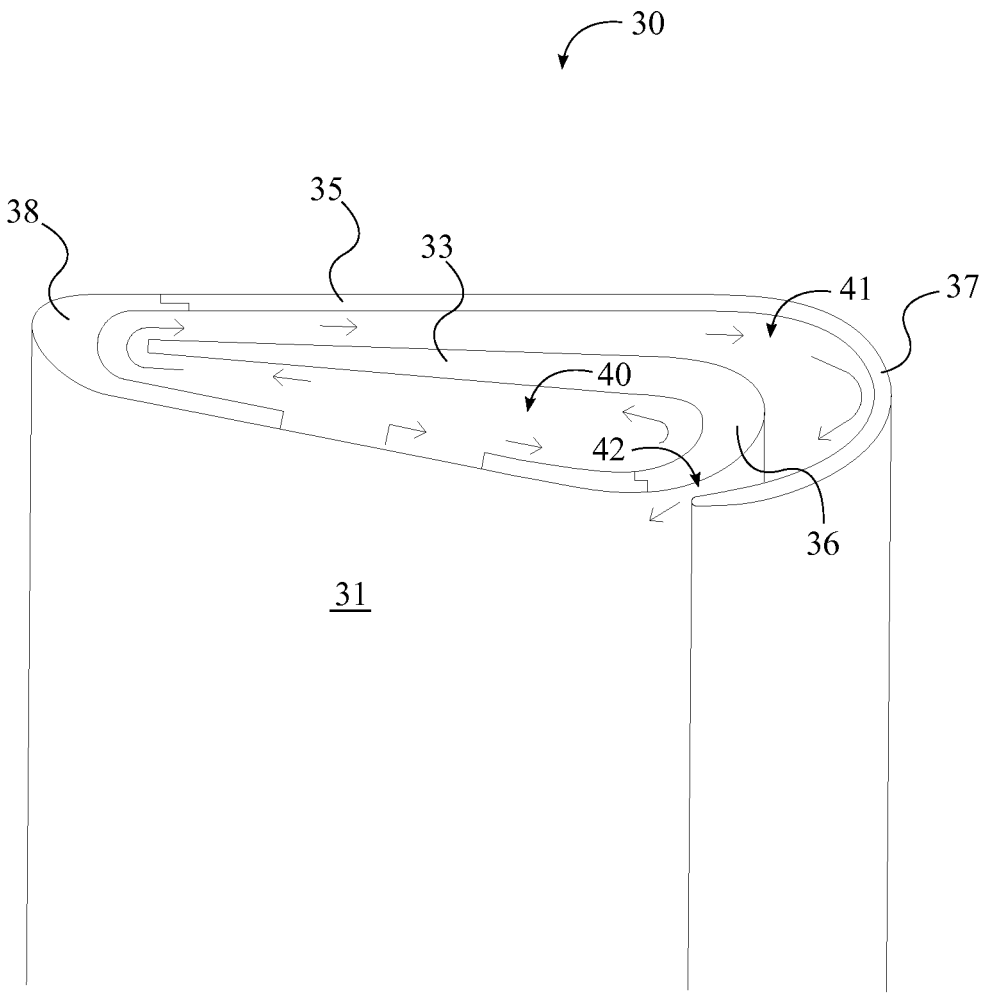
FIG. 6 is a sectional view showing the direction of the airflow through the air passage structure.
Figure 7:
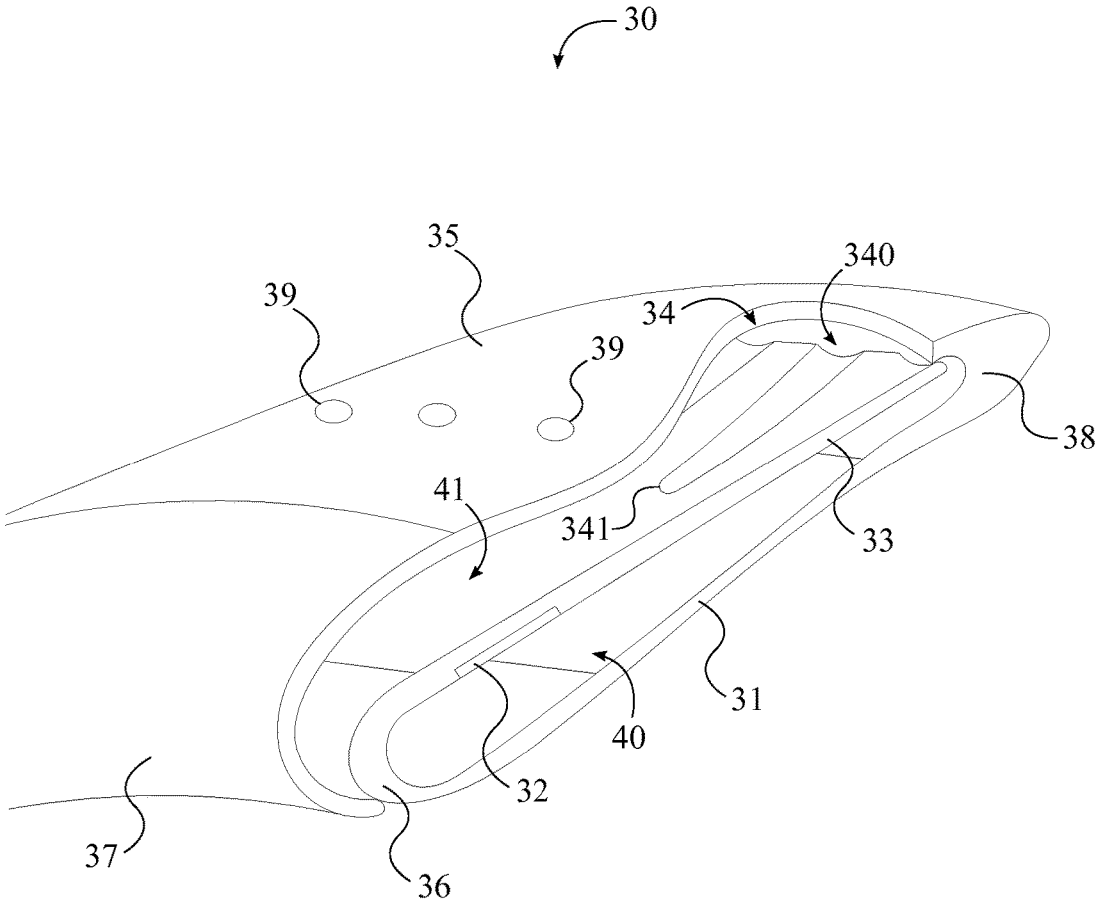
FIG. 7 is a sectional view of the air passage structure showing the plurality of intake orifices and the wired heater of the air passage structure.

In reference to FIG. 6-7, the separation wall 33 is positioned in between the interior wall 31 and the exterior wall 35, wherein the interior wall 31 provides the interior surface of the open loop assembly and the exterior wall 35 provides the exterior surface of the open loop assembly. The separation wall 33 divides the air passage structure 30 into two main channels through which the airflow is directed; namely an inflow air channel 40 and an outflow air channel 41. The first diffuser 36 is adjacently connected to the interior wall 31 and the separation wall 33 in order to form the inflow air channel 40, wherein the interior wall 31 and the separation wall 33 are positioned opposite each other across the first diffuser 36.

In further reference to FIG. 6-7, the first diffuser 36 has a curved cross section, allowing for undisturbed airflow along the surface of the first diffuser 36. The interior wall 31 and the separation wall 33 are positioned at an acute angle in relation to each other, wherein the interior wall 31 and the separation wall 33 constrict towards each other, away from the first diffuser 36. Resultantly, the cross section of the inflow air channel 40 is roughly teardrop shaped. The inflow air channel 40 is in fluid communication with the inflow air conduit 11, and as air enters the inflow air channel 40, the airflow follows the curvature of the first diffuser 36, wherein the velocity of the airflow is decreased, in turn increasing the pressure within the inflow air channel 40.

Figure 12:
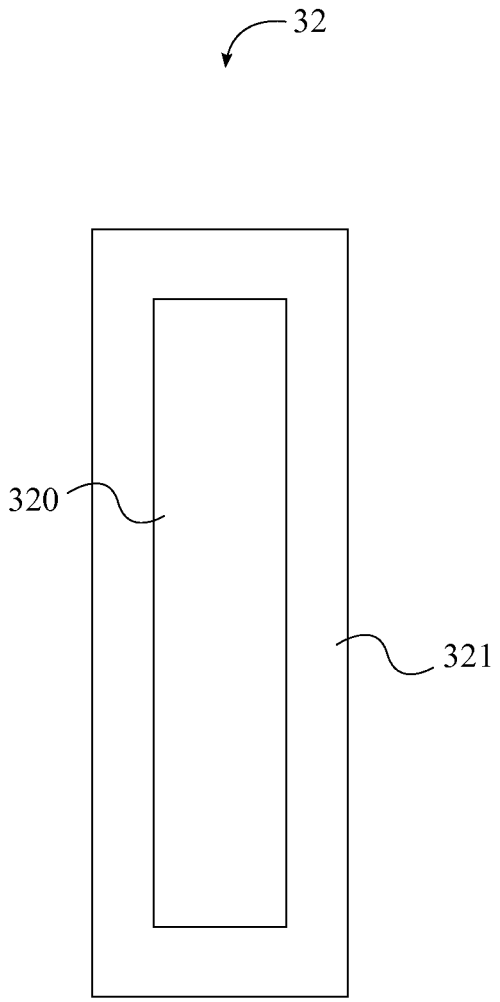
FIG. 12 is a cross sectional view of the wired heater.

In reference to FIG. 7, the wired heater 32 is positioned within the inflow air channel 40 and acts to further increase the pressure within the inflow air channel 40. The wired heater 32 increases the temperature of the air within the inflow air channel 40, which in turn increases the pressure within the inflow air channel 40 according to the ideal gas law. In reference to FIG. 12, the wired heater 32 comprises a resistive element 320 and an insulating element 321; the resistive element 320 being positioned within the insulating element 321. Current is passed through the resistive element 320, wherein the resistive element 320 then emits heat. The insulating element 321 absorbs the heat emitted from the resistive element 320 and distributes the heat throughout the inflow air channel 40.

In reference to FIG. 6-7, the constrictor 38 is adjacently connected to the interior wall 31 and the exterior wall 35 opposite the first diffuser 36, wherein the constrictor 38 connects the interior wall 31 and the exterior wall 35 at an acute angle. The constrictor 38 creates a reduced cross sectional area between the interior wall 31 and the separation wall 33 and a decreased cross sectional area between the exterior wall 35 and the separation wall 33, which creates a choke point for the airflow as the airflow exits the inflow air channel 40. The constrictor 38 has an inner, concave surface that allows for undisturbed airflow along the inner surface of the constrictor 38, wherein the inner surface area of the constrictor 38 is considerably less than the inner surface area of the first diffuser 36.

In reference to FIG. 6, the second diffuser 37 is adjacently connected to the exterior wall 35 opposite the constrictor 38, wherein the second diffuser 37, the exterior wall 35, and the separation wall 33 form the outflow air channel 41; the outflow air channel 41 being two times wider than the inflow air channel 40. The second diffuser 37 has an inner, concave surface that allows for undisturbed airflow along the inner surface of the second diffuser 37. The first diffuser 36 is nested within the second diffuser 37 to form an exit flow gap 42, wherein the exit flow gap 42 provides a narrow space between the first diffuser 36 and the second diffuser 37 through which the cooling exit flow is expelled. As such, the inner surface area of the second diffuser 37 is greater than the outer surface area of the first diffuser 36.

The configuration of the air passage structure 30 results in the inflow air channel 40 and the outflow air channel 41 being dilated away from the constrictor 38. As air enters the inflow air channel 40, the airflow is slowed down along the first diffuser 36, increasing the pressure within the inflow air channel 40. The constrictor 38 creates a pressure differential between the inflow air channel 40 and the outflow air channel 41, wherein the velocity of the airflow is increased, driving air into the outflow air channel 41. The second diffuser 37 again slows down the airflow, creating a lower pressure within the outflow air channel 41. As the outflow air channel 41 approaches the exit flow gap 42, the outflow air channel 41 again constricts, creating a pressure differential across the exit flow gap 42 between the outflow air channel 41 and the surrounding environment.

Figure 8:
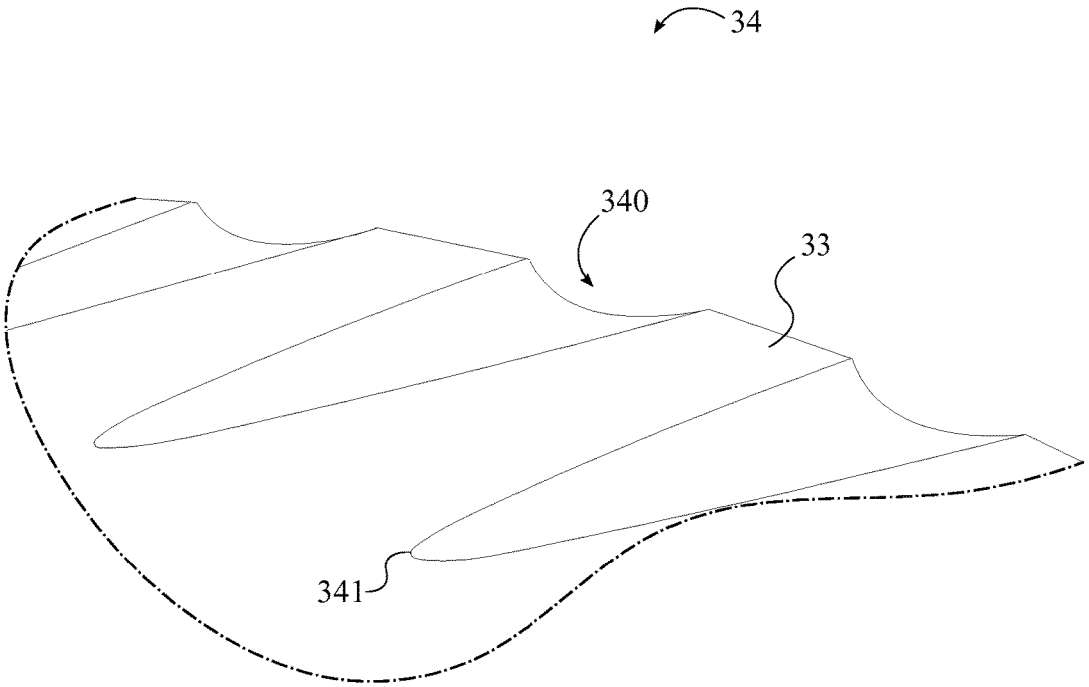
FIG. 8 is a sectional view of the cone-tip hole grid traversing into the separation wall.

In reference to FIG. 7-8, the cone-tip hole grid 34 traverses into the separation wall 33 and is positioned adjacent to the constrictor 38. The cone-tip hole grid 34 extends all the way around the separation wall 33 and influences the surface of the separation wall 33 within the inflow air channel 40 and the outflow air channel 41, as well as the open cross sectional area through the separation wall 33 for airflow between the inflow air channel 40 and the outflow air channel 41. The cone-tip hole grid 34 comprises a plurality of tip holes 340 and a plurality of cone-shaped channels 341;

the plurality of tip holes 340 and the plurality of cone-shaped channels 341 being evenly or irregularly dispersed around the cone-tip hole grid 34.

In further reference to FIG. 7-8, each of the plurality of tip holes 340 is perimetrically positioned about the separation wall 33, traversing into the edge of the separation wall 33 adjacent to the constrictor 38; the plurality of tip holes 340 permitting airflow through designated partitions of the separation wall 33. The plurality of cone-shaped channels 341 extends from the plurality of tip holes 340, along the separation wall 33, wherein each of the plurality of cone-shaped channels 341 is tapered away from the constrictor 38. The plurality of cone-shaped channels 341 is present on both sides of the separation wall 33 (within the inflow air channel 40 and the outflow air channel 41), and directs air towards and away from the plurality of tip holes 340 in the direction of the airflow.

In reference to FIG. 7, the plurality of intake orifices 39 traverse through the exterior wall 35 being in fluid communication with the outflow air channel 41. The plurality of intake orifices 39 allows air from the surrounding environment to enter the outflow air channel 41 and mix with the heated airflow from the inflow air channel 40. Each of the plurality of intake orifices 39 is angled with respect to the outflow air channel 41, such that as the airflow within the outflow air channel 41 passes over the plurality of intake orifices 39, air is pulled into the outflow air channel 41 rather than expelled.

In reference to FIG. 1-2, the light assembly 5 is adjacently connected to the housing 1, wherein the air passage structure 30 is oriented around the light assembly 5. If the air passage structure 30 is pivotally connected to the housing 1 as shown in FIG. 9, then the angle at which the air passage structure 30 encompasses the light assembly 5 can be adjusted. The light assembly 5 is used to provide directed light for illuminating the space in which the present invention is placed. The light assembly 5 can be used simultaneously with the airflow assembly 2, or the light assembly 5 can be used alone without the cooling effect of the airflow assembly 2. Similarly, the airflow assembly 2 can be used to cool the room without the use of the light assembly 5.

In reference to FIG. 4, the light assembly 5 comprises a driver-integrated light board 50 and a light diffuser 51. The driver-integrated light board 50 provides the means for illuminating the room with which the present invention is placed. The light diffuser 51 provides a cover for the driver-integrated light board 50 and also diffuses the light produced from the driver-integrated light board 50 in order to provide soft lighting within the room. The driver-integrated light board 50 is mounted to the housing 1 and the light diffuser 51 is connected to the housing 1, wherein the driver-integrated light board 50 is positioned in between the housing 1 and the light diffuser 51.

Figure 13:
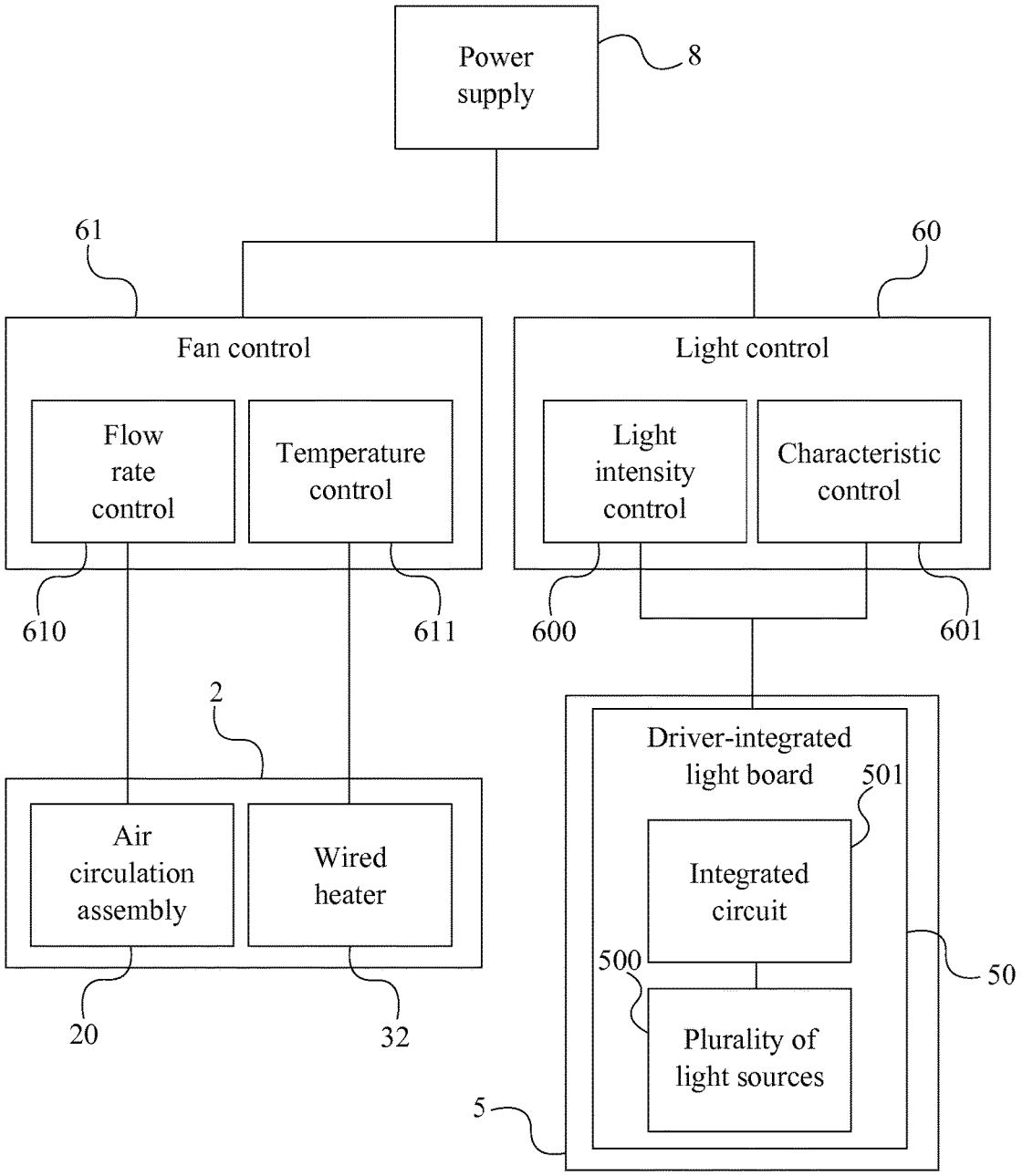
FIG. 13 is a diagram depicting the electrical connections of the present invention.

In further reference to FIG. 4, the driver-integrated light board 50 comprises a plurality of light sources 500 and an integrated circuit 501. The plurality of light sources 500 is electrically connected to the integrated circuit 501 as depicted in FIG. 13, and depending on the configuration of the present invention, the plurality of light sources 500 may also be mounted on the integrated circuit 501. The integrated circuit 501 regulates the current delivered to the plurality of light sources 500 in order to turn the plurality of light sources 500 on and off, as well as dim the plurality of light sources 500. In the preferred embodiment of the present invention, each of the plurality of light sources 500 is a light emitting diode to provide efficient lighting.

In reference to FIG. 1-2, the control panel 6 is adjacently connected to the housing 1 and provides a means for controlling both the airflow assembly 2 and the light assembly 5. As such, the control panel 6 comprises a fan control 61 and a light control 60; the fan control 61 operating the airflow assembly 2 and the light control 60 operating the light assembly 5. In reference to FIG. 13, the fan control 61 is electrically connected to the airflow assembly 2; more specifically, the fan control 61 is electrically connected to the air circulation assembly 20 and the wired heater 32. Meanwhile, the light control 60 is electrically connected to the light assembly 5; more specifically, the light control 60 is electrically connected to the driver-integrated light board 50.

The fan control 61 is used to increase or decrease the volumetric flow rate of the airflow and increase or decrease the temperature. As such, the fan control 61 comprises a flow rate control 610 and a temperature control 611 as shown in FIG. 2; the flow rate control 610 being electrically connected to the air circulation assembly 20 and the temperature control 611 being electrically connected to the wired heater 32 as shown in FIG. 13. The flow rate control 610 determines the amount of current delivered to the air circulation assembly 20, and thus the speed at which the air circulation assembly 20 rotates and pulls in air. The flow rate control 610 can be as simple as turning the air circulation assembly 20 on and off, or may allow the user to select between different speed settings. The temperature control 611 determines the amount of current delivered to the wired heater 32; more specifically, the resistive element 320. As more current is applied to the resistive element 320, the resistive element 320 produces more heat that is then dissipated within the inflow air channel 40.

The light control 60 is used to adjust the intensity of the light and change characteristics of the light. As such, the light control 60 comprises a intensity control 600 and a characteristic control 601 as shown in FIG. 2; both the intensity control 600 and the characteristic control 601 being electrically connected to the driver-integrated light board 50 as shown in FIG. 13. The intensity control 600 determines the amount of current delivered to the plurality of light sources 500, and thus the amount of light produced from each of the plurality of light sources 500. The intensity control 600 can be as simple as turning the plurality of light sources 500 on and off, or may allow the user to dim the plurality of light sources 500 to a level between being fully on and fully off. The characteristic control 601 allows the user to change characteristics of the plurality of light sources 500, such as the color of light emitted from the plurality of light sources 500, or selecting specific lights from the plurality of light sources 500 to be turned on or off.

In reference to FIG. 13, the power supply 8 is used to deliver current to the other components of the present invention. As such, the power supply 8 is electrically connected to the airflow assembly 2, the light assembly 5, and the control panel 6. More specifically, the power supply 8 is electrically connected to the air circulation assembly 20 and the driver-integrated light board 50. The power supply 8 is positioned within the housing 1 and can be an alternating current adapter to be used with a power cable, a direct current connection, or one or more batteries.

Figure 10:
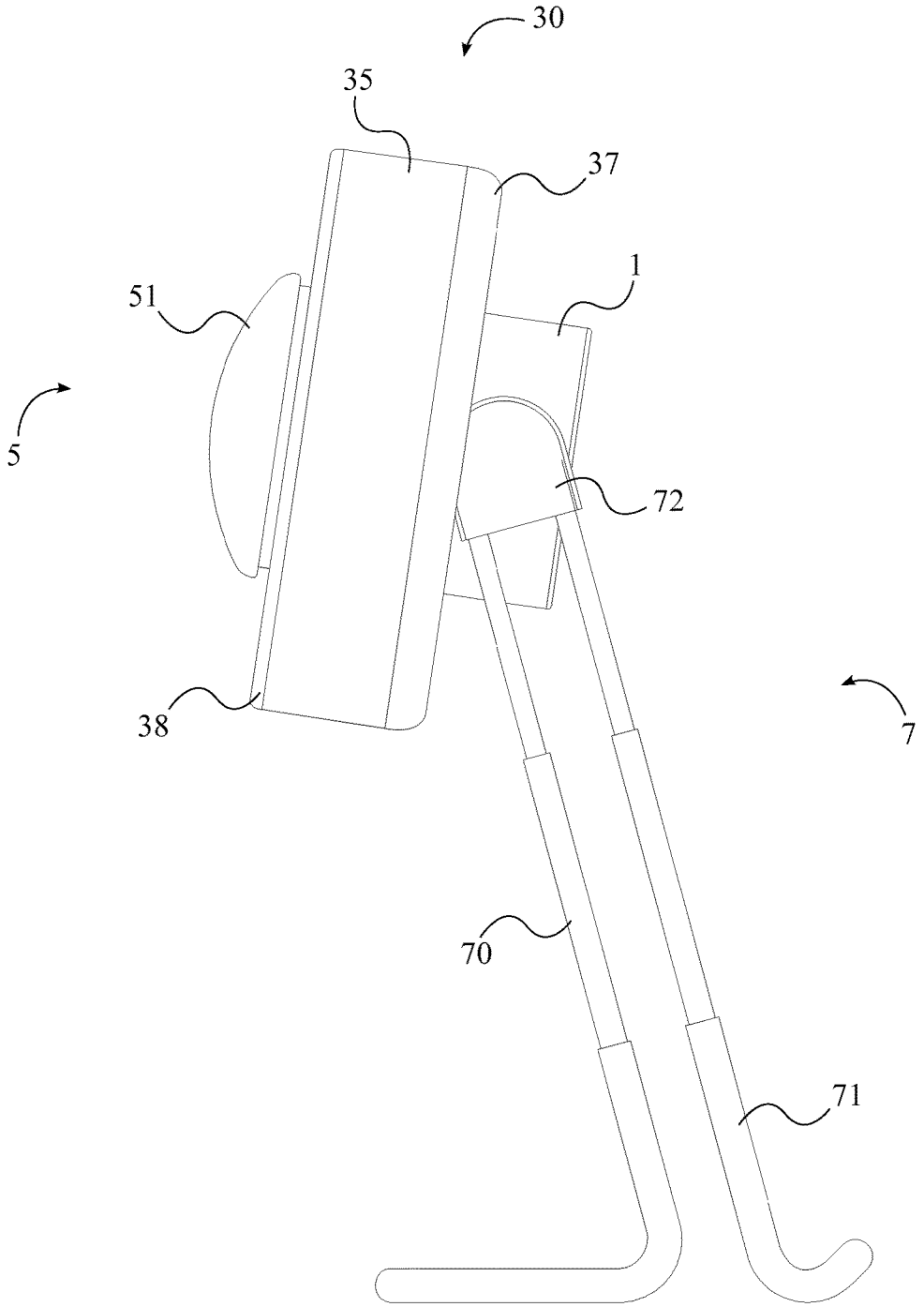
FIG. 10 is a right side elevational view of the present invention, wherein the mounting assembly has a telescoping first support and second support.

The mounting assembly 7 is adjacently connected to the housing 1 and provides a means for supporting the housing 1 on or from a surface. In reference to FIG. 10, in one embodiment of the present invention, the mounting assembly 7 comprises a first support 70, a second support 71, and a pair of mounts 72. Each of the pair of mounts 72 is pivotally connected to the housing 1; the housing 1 being positioned in between each of the pair of mounts 72. Both the first support 70 and the second support 71 are adjacently connected to each of the pair of mounts 72, supporting and lifting the housing 1 away from the surface on which the first support 70 and the second support 71 are positioned. The pivotal connection of the pair of mounts 72 allows the housing 1 to be vertically angled in order to change the direction of the cooling air flow and lighting. Additionally, the first support 70 and the second support 71 may be telescopic in order to change the height of the housing 1.

Figure 3:
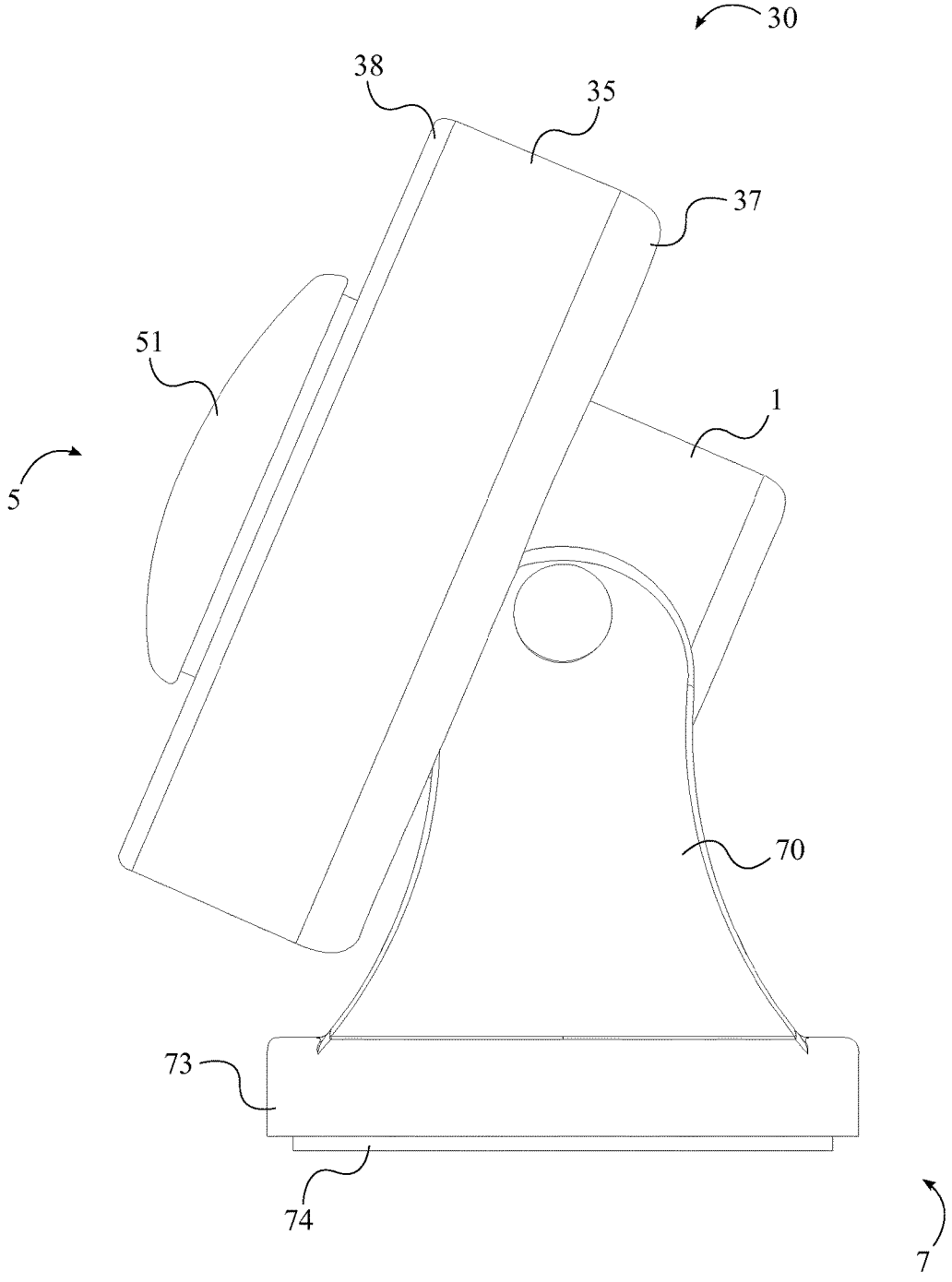
FIG. 3 is a right side elevational view of the present invention.

In reference to FIG. 2-3, in another embodiment of the present invention, the mounting assembly 7 comprises a first support 70, a second support 71, a mount base 73, and a turntable 74. The first support 70 and the second support 71 are adjacently connected to the mount base 73; the first support 70 and the second support 71 being parallel and positioned opposite each other across the mount base 73. The housing 1 is pivotally connected to the first support 70 and the second support 71, allowing the housing 1 to be vertically angled. The turntable 74 is rotatably connected to the mount base 73 opposite the first support 70 and the second support 71, wherein the turntable 74 allows the housing 1 to spun around a vertical axis.

Figure 11:
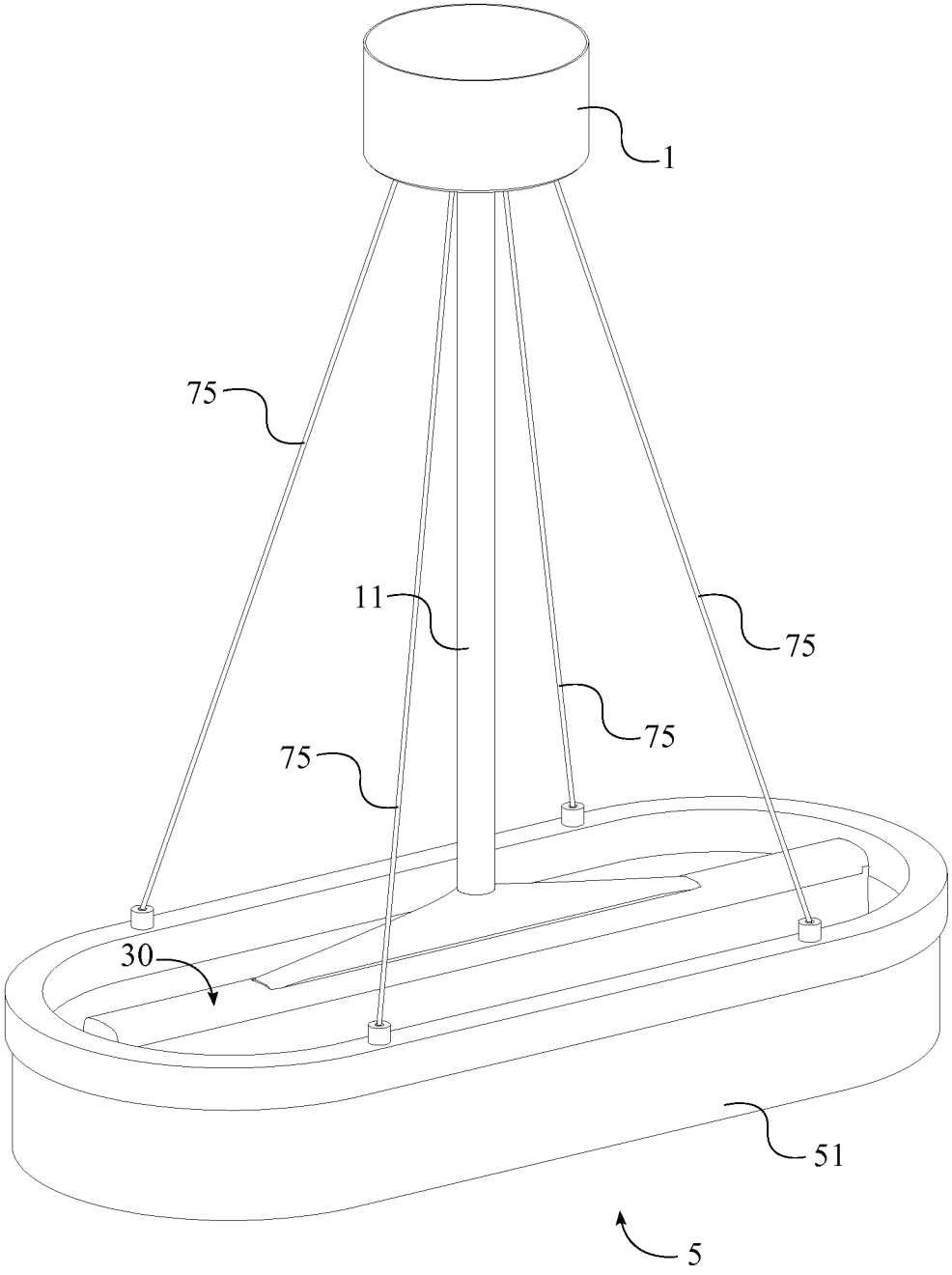
FIG. 11 is a perspective view of the present invention, wherein the light assembly is supported by a plurality of suspension wires.

In reference to FIG. 11, in yet another embodiment, the present invention is configured to hang from a ceiling and further comprises a plurality of suspension wires 75. The housing 1 is mounted to the ceiling, while the inflow air conduit 11 extends downwards, away from the ceiling. In addition to delivering air to the air passage structure 30, the inflow air conduit 11 acts as a support member, suspending the air passage structure 30 in midair. The light assembly 5 is positioned around the air passage structure 30 and supported by the plurality of suspension wires 75. Each of the plurality of suspension wires 75 is terminally connected to both the housing 1 and the light assembly 5, wherein the light assembly 5 is suspended in midair, encompassing the air passage structure 30. The light assembly 5 may additionally be connected to the air passage structure 30 for further structural support.

Although the invention has been explained in relation to its preferred embodiment, it is to be understood that many other possible modifications and variations can be made without departing from the spirit and scope of the invention as hereinafter claimed.

What is claimed is:

1. A bladeless cooling light comprising:

a lighting assembly;

an airflow assembly comprising an air circulation assembly and an air passage structure;

the air passage structure comprising an interior wall, a separation wall, an exterior wall, a first diffuser, a second diffuser, and a constrictor;

the separation wall being positioned in between the interior wall and the exterior wall;

the first diffuser being adjacently connected to both the interior wall and the separation wall to form an inflow air channel;

the constrictor being adjacently connected to the interior wall and the exterior wall opposite the first diffuser;

the second diffuser being adjacently connected to the exterior wall opposite the constrictor to form an outflow air channel;

the first diffuser being nested within the second diffuser to form an exit flow gap;

the air passage structure and the lighting assembly being adjacently connected to a housing;

the air passage structure further comprising a cone-tip hole grid;

the cone-tip hole grid traversing into the separation wall; and the cone-tip hole grid being positioned adjacent to the constrictor.

2. The bladeless cooling light as claimed in claim 1 comprising:

the cone-tip hole grid comprising a plurality of tip holes and a plurality of cone-shaped channels;

the plurality of tip holes being perimetrically positioned about the separation wall; and the plurality of cone-shaped channels extending from the plurality of tip holes, along the separation wall.

3. The bladeless cooling light as claimed in claim 1 comprising:

the air passage structure further comprising a plurality of intake orifices; and the plurality of intake orifices traversing through the exterior wall.

4. The bladeless cooling light as claimed in claim 1 comprising:

the air passage structure further comprising a wired heater; and the wired heater being positioned within the inflow air channel.

5. The bladeless cooling light as claimed in claim 4 comprising:

the wired heater comprising a resistive element and an insulating element; and the insulating element encompassing the resistive element.

6. The bladeless cooling light as claimed in claim 1 comprising:

the air circulation assembly being positioned within the housing; and the air passage structure and the lighting assembly being adjacently connected to the housing.

7. The bladeless cooling light as claimed in claim 6 comprising:

the housing comprising a main air intake and an inflow air conduit;

the air circulation assembly being positioned in between the main air intake and the inflow air conduit; and the inflow air channel being in fluid communication with the main air intake through the inflow air conduit.

8. The bladeless cooling light as claimed in claim 6 comprising:

the air passage structure being pivotally connected to the housing.

9. The bladeless cooling light as claimed in claim 1 comprising:

the lighting assembly comprising a driver-integrated light board and a light diffuser; and the driver-integrated light board being mounted in between the housing and the light diffuser.

10. The bladeless cooling light as claimed in claim 9 comprising:

the driver-integrated light board comprising a plurality of light sources and an integrated circuit; and the plurality of light sources being electrically connected to the integrated circuit.

11. The bladeless cooling light as claimed in claim 1 comprising:

a light control; and the light control being electrically connected to the lighting assembly.

12. The bladeless cooling light as claimed in claim 1 comprising:

a fan control; and the fan control being electrically connected to the air circulation assembly.

13. A bladeless cooling light comprising:

a lighting assembly;

an airflow assembly comprising an air circulation assembly and an air passage structure;

the air passage structure comprising an interior wall, a wired heater, a separation wall, a cone-tip hole grid, an exterior wall, a first diffuser, a second diffuser, a constrictor, and a plurality of intake orifices;

the separation wall being positioned in between the interior wall and the exterior wall;

the first diffuser being adjacently connected to both the interior wall and the separation wall to form an inflow air channel;

the constrictor being adjacently connected to the interior wall and the exterior wall opposite the first diffuser;

the second diffuser being adjacently connected to the exterior wall opposite the constrictor to form an outflow air channel;

the first diffuser being nested within the second diffuser to form an exit flow gap;

the air passage structure and the lighting assembly being adjacently connected to a housing;

the cone-tip hole grid traversing into the separation wall;

the cone-tip hole grid being positioned adjacent to the constrictor;

the plurality of intake orifices traversing through the exterior wall; and the wired heater being positioned within the inflow air channel.

14. The bladeless cooling light as claimed in claim 13 comprising:

the cone-tip hole grid comprising a plurality of tip holes and a plurality of cone-shaped channels;

the plurality of tip holes being perimetrically positioned about the separation wall; and the plurality of cone-shaped channels extending from the plurality of tip holes, along the separation wall.

15. The bladeless cooling light as claimed in claim 13 comprising:

the wired heater comprising a resistive element and an insulating element; and the insulating element encompassing the resistive element.

16. The bladeless cooling light as claimed in claim 13 comprising:

the air circulation assembly being positioned within the housing; and the air passage structure and the lighting assembly being adjacently connected to the housing.

17. The bladeless cooling light as claimed in claim 16 comprising:

the housing comprising a main air intake and an inflow air conduit;

the air circulation assembly being positioned in between the main air intake and the inflow air conduit; and the inflow air channel being in fluid communication with the main air intake through the inflow air conduit.

18. The bladeless cooling light as claimed in claim 16 comprising:

the air passage structure being pivotally connected to the housing.

19. The bladeless cooling light as claimed in claim 13 comprising:

the lighting assembly comprising a driver-integrated light board and a light diffuser; and the driver-integrated light board being mounted in between the housing and the light diffuser.

* * * * *